US007166787B2

(12) United States Patent
Rand

(10) Patent No.: US 7,166,787 B2
(45) Date of Patent: Jan. 23, 2007

(54) MUSICAL INSTRUMENT BOW

(76) Inventor: Leah Z. G. Rand, 5511 Greystone St., Chevy Chase, MD (US) 20815

( * ) Notice: Subject to any disclaimer, the term of this patent is extended or adjusted under 35 U.S.C. 154(b) by 156 days.

(21) Appl. No.: 11/050,849

(22) Filed: Jan. 27, 2005

(65) Prior Publication Data

US 2006/0162527 A1 Jul. 27, 2006

(51) Int. Cl.
*G10D 1/02* (2006.01)

(52) U.S. Cl. ..... 84/282; 84/325

(58) Field of Classification Search ..... 84/282, 84/283, 325; D17/20
See application file for complete search history.

(56) References Cited

U.S. PATENT DOCUMENTS 1,151,413 A * 8/1915 Steckenreiter ..... 84/282
3,272,055 A * 9/1966 Henkle ..... 84/283
3,991,647 A * 11/1976 Darling ..... 84/282
4,854,212 A 8/1989 Levin
D322,270 S 12/1991 Concoff
5,301,589 A 4/1994 Spadafora
5,355,757 A 10/1994 Plummer
5,540,133 A 7/1996 Draper
5,670,727 A 9/1997 Xiao
5,918,297 A 6/1999 Pliassov
5,977,462 A 11/1999 Wolfson
6,280,654 B1 8/2001 Digman
6,777,600 B2 8/2004 Daring

* cited by examiner

*Primary Examiner*—Lincoln Donovan
*Assistant Examiner*—Jianchun Qin
(74) *Attorney, Agent, or Firm*—Jeffrey S. Melcher; Manelli Densison & Selter, PLLC

(57) ABSTRACT

Provided are an improved musical instrument bow having different sections of hair identified, a modular hair device for use in the improved musical instrument bow and a method of teaching use of a stringed instrument using the improved musical instrument bow.

22 Claims, 2 Drawing Sheets

MUSICAL INSTRUMENT BOW

BACKGROUND OF THE INVENTION

The invention relates an improved musical instrument bow having different sections of hair identified, a modular hair device for use in the improved musical instrument bow, and a method of teaching use of a stringed instrument using the improved musical instrument bow.

FIELD OF INVENTION

Stringed instruments, such as the violin, viola, cello, and bass are typically played using a bow. The bow consists of a bowstick having a frog at one end and a tip at an opposing end. Hairs are held between the frog and tip of the bowstick. At the tip end of the bowstick, the hairs are usually held in place by inserting an end of the hairs into a hole and then inserting a plug into the hole. At the frog end of the bowstick, the hairs are usually mounted to a ferrule on the frog and the entire frog moved relative to the tip by use of a screw device to apply tension to the hairs. Alternatively, the hairs can be passed through a ferrule and then wound on a screw device used to apply desired tension to the hairs. Rosin is usually applied to the hairs to provide tackiness and heighten friction between the hairs and instrument strings.

During play of the stringed instruments different sections of the hairs must contact the strings. For example, strong sound is usually produced by contacting a center section of the hairs with the strings. In the playing of staccato one usually uses the tip or base sections of the hairs. Students learning to play stringed instruments have difficulty distinguishing the different sections of the hairs to contact the strings. Furthermore, teachers also have difficulty showing students where the different sections on the hairs are delineated. Often tape or other marks are made on the bowstick to show approximately where on the hairs the different sections are located. However, such marks on the bowstick are far removed from the hairs and, thus, there still remains ambiguity as to where on the hairs the sections are delineated.

There are many known devices for use in teaching students how to use a bow on stringed instruments, as shown in U.S. Pat. Nos. 6,977,600; 5,670,727; 5,355,757; 5,301,589; 4,854,212; and Des. 322,270. However, the devices are difficult to adapt to different sized bows and techniques, and do not provide an efficient and easy method for distinguishing the different sections of the bow hairs.

U.S. Pat. No. 6,280,654 discloses the use of glow in the dark rosin that is suitable for use on violin bow strings. However, this patent does not teach or suggest using the rosin to identify different sections of the bow hairs.

There is a need for a simple and effective way to unambiguously distinguish the different sections of hairs mounted on a bow.

SUMMARY OF INVENTION

An objective of the present invention is to provide a simple and effective way to unambiguously distinguish different sections of the hairs of a musical instrument bow.

Another objective of the present invention is to provide a simplified modular hair device.

A further objective of the present invention is to provide a simple and effective method for teaching students how to play stringed instruments.

These objectives and other objectives are met by a musical instrument bow comprising:

a plurality of hairs having playing sections of the hairs identified to distinguish different playing sections of the hairs that contact strings of a musical instrument during playing of the instrument; and a bowstick constructed and arranged to hold the plurality of hairs, the bowstick having a frog at one end and a tip at an opposing end, the plurality of hairs being held between the frog and tip.

The above objects are also met by a modular musical instrument bow hair device comprising:

a plurality of musical instrument bow hairs having playing sections thereof identified; and a first binder at one end of the hairs for binding the hairs and preventing relative movement among the hairs.

The above objectives are also met by a method of teaching use of a stringed instrument comprising:

instructing a student to contact a stringed instrument with different playing sections of bow hairs, wherein the different playing sections of the bow hairs are identified to distinguish the playing sections from one another.

DETAILED DESCRIPTION OF PREFERRED EMBODIMENTS

The invention will be described with reference to the attached Figs. without being limited thereto.

Figure 1:
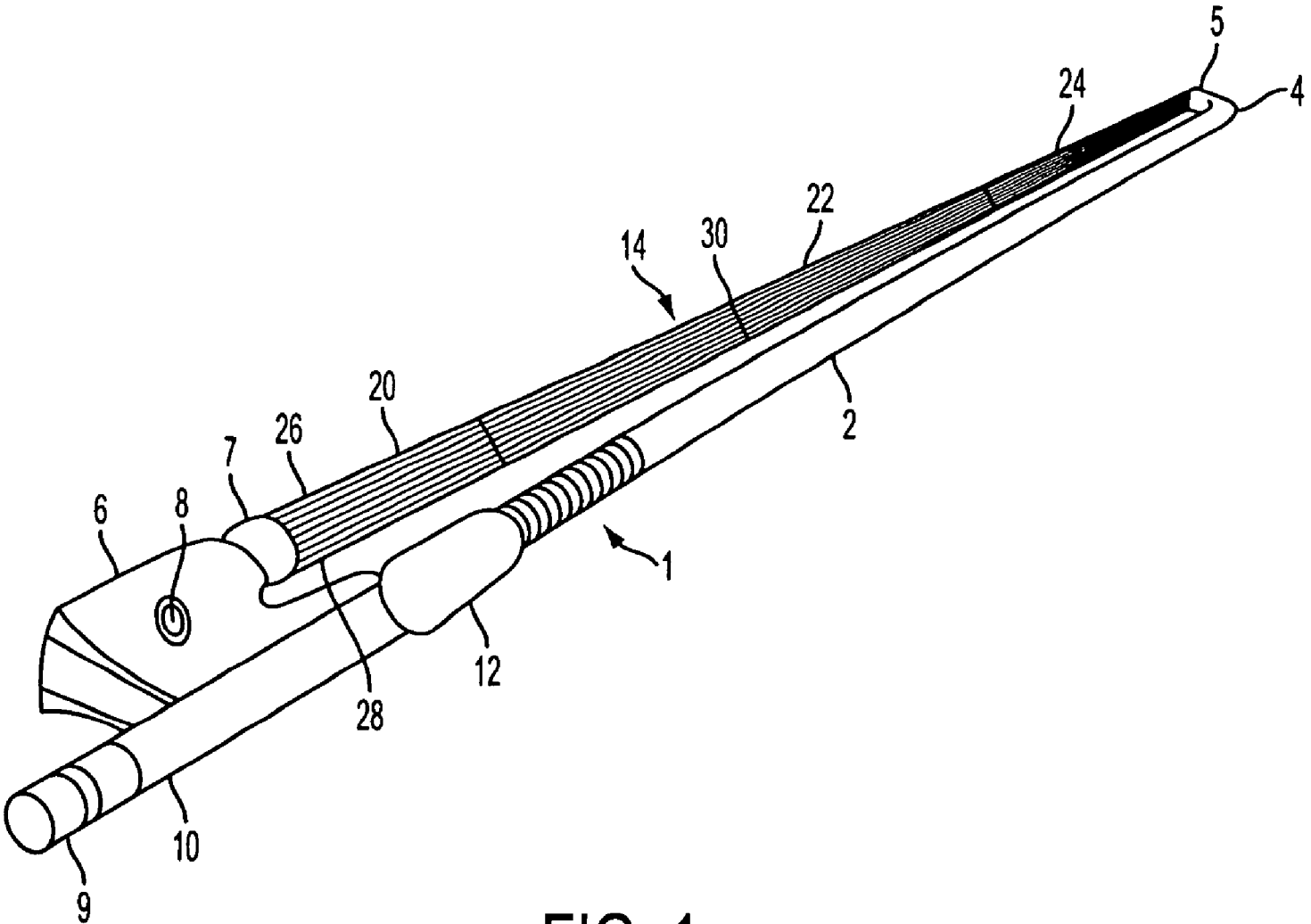
FIG. 1 illustrates a musical instrument bow having different sections of the hairs identified.

FIG. 1 illustrates a musical instrument bow 1 having a bowstick 2. The bowstick 2 has a tip 4 at one end and a frog 6 at an opposing end. The frog 6 is located near the base 10 and finger rest 12 of the bow and usually has an eye 8. A plurality of hairs 14 are held between the frog 6 and tip 4. At the tip 4, the hairs 14 are held in place by inserting an end of the hairs 14 into a hole 5 and then inserting a plug into the hole 5. While a hole 5 and plug are shown, any suitable structure for fastening the hairs 14 to the tip 4 can be used. At the frog 6, the hairs 14 are fastened to a ferrule 7. Alternatively, the hairs can be passed through a ferrule and then wound on a screw device (not shown). The fastening of the hairs 14 to a frog 6 is now well known and any means for fastening the hair to the frog can be utilized as desired. A screw device 9 is used to apply desired tension to the hairs 14 by moving the frog 6 closer or farther from tip 4 depending on the direction the screw device 9 is turned. However, any suitable means for tensioning the hairs 14 can be utilized as desired, even the tensioning means shown in U.S. Pat. No. 5,918,297.

Different sections of the hairs 14 are identified so that they can be easily distinguished from one another, for example, by color. As shown in FIG. 1, for example, three sections are identified, the base section 20, the center section 22, and the tip section 24. The term sections is understood to mean different portions of the hairs 14 in a lengthwise direction when they are mounted between the frog 6 and tip 4. While three sections are preferred, more or less sections can be identified using the present invention, with two sections being the minimum number.

Preferably, the sections 20, 22 and 24 are identified using colors. When only colors are used to distinguish sections, adjacent sections should be different colors. While use of colors is preferred, the different sections can be identified as desired using any combination of marks such as numbers, lines, letters, colors, patterns, etc. Preferably, the marks on the hairs do not interfere with or substantially alter playing of the instrument.

If desired, an up section 28 of hairs 14 can be identified according to the present invention and a down portion 26 of hairs 14 left unmarked, since the down portion 26 is usually covered with resin. The down portion 26 of hairs is well known to be those hairs that contact the strings and the up portion 28 are those that are visible to the player.

Preferably, the exact center of the hairs is marked with a line 30.

While a plurality of hairs 14 has been shown and are preferred, the invention is application to a single string bow. Furthermore, the hairs 14 can be formed from any desired synthetic or natural material as desired. Preferably, the hairs 14 comprise horse hair.

The hairs 14 can be identified using any conventional method of applying markings, such as dying, screening, printing, coloring, and drawing, as desired, which are well within the skill of those skilled in the art.

Loose hairs 14 are difficult for students install on the bowstick 1 and, thus, often instructors or professional specialist technicians must install the hairs 14. With the addition of indentifying sections of the hairs 14 according to the present invention, the installation of the hairs 14 is now even more difficult since the sections of individual hairs 14 must be aligned before mounting them on the bowstick 2.

Figure 2:
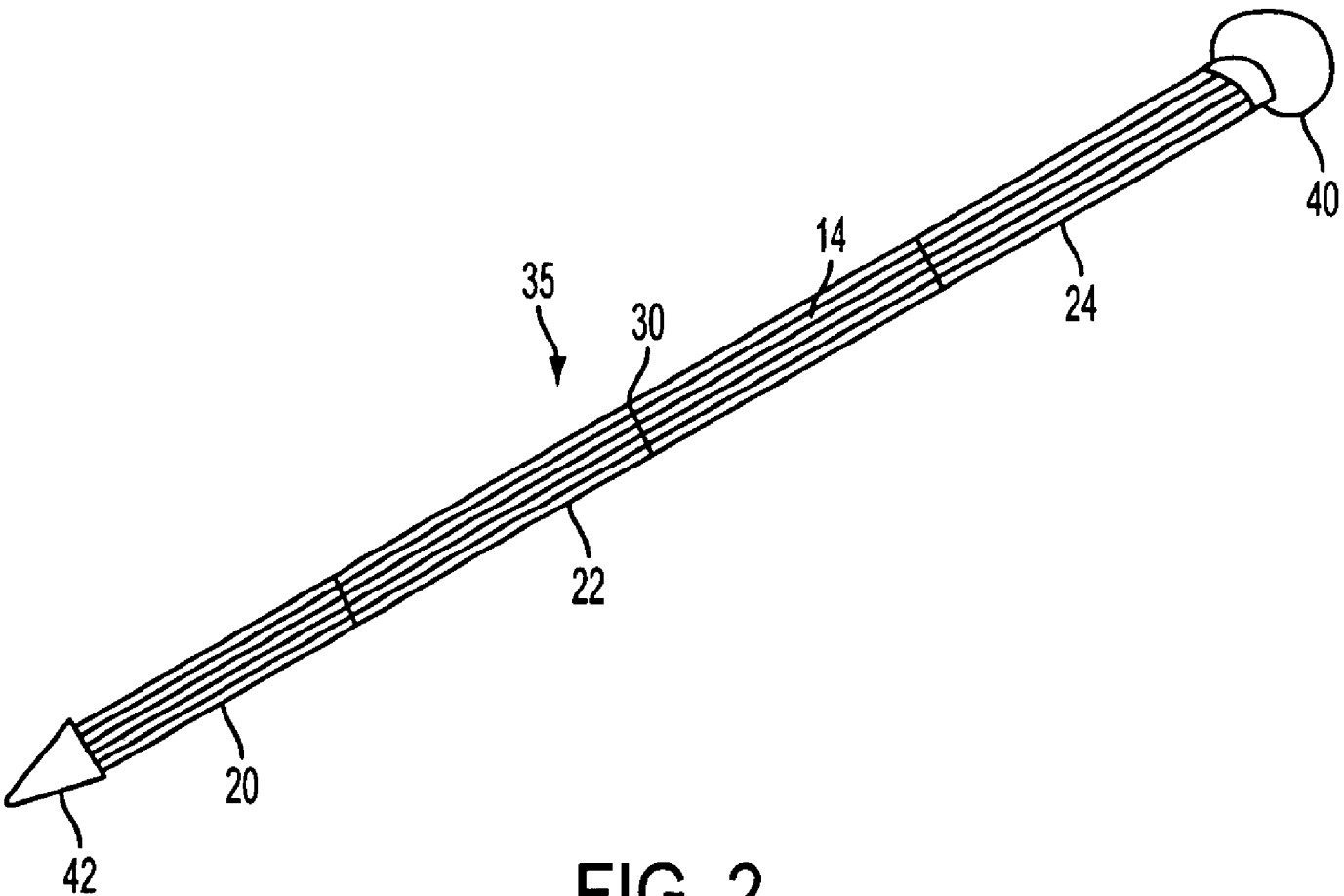
FIG. 2 illustrates a modular musical instrument bow hair device.

As shown in FIG. 2, the invention also provides a musical instrument bow hair device 35 comprising bound hairs 14, such that the individual hairs cannot move relative to one another. The hairs can be bound at one end or at both ends using binders. In this manner, the bound hairs can easily be installed on the bowstick 2. The binder(s) can further have the function of a mount for the hairs to the bowstick 2. For example, instead of using a hole and plug at the tip, the hairs 14 can inserted in a hole and a first binder 40 at one end of the hairs 14 used to bind the hairs to the tip 4. A second binder 42 at the other end of the hairs can be used to bind the hairs 14 to the frog 6. In this embodiment, the second binder 42 is capable of passing through the hole 5 at the tip 4, whereas the first binder 42 cannot pass through the hole 5. For example, simple crimping binders can be used. Other binding means can also be used as desired, such as fasteners, clamps, clasps, screws, glues, and melts. Other means for mounting the first binder 40 to the tip can also be used, such as screws, clamps, notches, and clasps, as desired. Similarly, any desired means for mounting the second binder 42 to the frog 6 can be used.

While the claimed invention has been described in detail and with reference to specific embodiments thereof, it will be apparent to one of ordinary skill in the art that various changes and modifications can be made to the claimed invention without departing from the spirit and scope thereof.

I claim:

1. A musical instrument bow comprising:

a plurality of hairs having playing sections of the hairs identified to distinguish different playing sections of the hairs that contact strings of a musical instrument during playing of the instrument, wherein the playing sections are identified by at least one mark on the hairs that does not interfere with or substantially alter playing of a musical instrument; and a bowstick constructed and arranged to hold the plurality of hairs, the bowstick having a frog at one end and a tip at an opposing end, the plurality of hairs being held between the frog and tip.

2. A musical instrument bow according to claim 1, wherein the hairs are natural or synthetic fibers.

3. A musical instrument bow according to claim 1, wherein the playing sections are identified using colors.

4. A musical instrument bow according to claim 3, wherein three playing sections of the hairs are identified.

5. A musical instrument bow according to claim 4, wherein the three playing sections represent a tip section of the hairs, a center section of the hairs, and a base section of the hairs.

6. A musical instrument bow according to claim 1, wherein the playing sections are identified using any one or more marks selected from the group consisting of lines, colors, numbers, letters and patterns.

7. A musical instrument bow according to claim 1, wherein only a top portion of the hairs is identified.

8. A musical instrument bow according to claim 1, wherein the hairs comprise a modular device such that at least one end of the hairs is bound to prevent the hairs from moving relative to one another prior to installation on the bowstick.

9. A musical instrument bow according to claim 1, wherein the center of the hairs is marked with a line on the hairs.

10. A modular musical instrument bow hair device comprising:

a plurality of musical instrument bow hairs having playing sections thereof identified, wherein the playing sections are identified by at least one mark on the hairs that does not interfere with or substantially alter playing of a musical instrument; and a first binder at one end of the hairs for binding the hairs and preventing relative movement among the hairs.

11. A modular musical instrument bow hair device according to claim 10, further comprising a second binder at another end of the hairs.

12. A modular musical instrument bow hair device according to claim 11, wherein the second binder is constructed and arranged to mount to a frog on a bowstick.

13. A modular musical instrument bow hair device according to claim 10, wherein the first binder is constructed and arranged to mount to a tip of a bowstick.

14. A modular musical instrument bow hair device according to claim 10, wherein the center of the hairs is marked with a line on the hairs.

15. A method of teaching use of a stringed instrument comprising:

instructing a student to contact a stringed instrument with different playing sections of bow hairs, wherein the different playing sections of the bow hairs are identified to distinguish the playing sections from one another, wherein the playing sections are identified by at least one mark on the hairs that does not interfere with or substantially alter playing of a musical instrument.

16. A method according to claim 15, wherein the playing sections are identified using colors.

17. A method according to claim 16, wherein three playing sections of the hairs are identified.

18. A method according to claim 17, wherein the three playing sections represent a tip section of the hairs, a center section of the hairs, and a base section of the hairs.

19. A method according to claim 15, wherein the playing sections are identified using any one or more markings marks selected from the group consisting of lines, colors, numbers, letters and patterns.

20. A method according to claim 15, wherein only a top portion of the hairs is identified.

21. A method according to claim 15, wherein the hairs are a modular device such that at least one end of the hairs is bound to prevent the hairs from moving relative to one another.

22. A method of making a modular musical instrument bow hair device comprising plurality of bound hairs for a musical instrument bow having playing sections of the hairs identified to distinguish different playing sections of the hairs that contact strings of a musical instrument during playing of the instrument, wherein the playing sections are identified by at least one mark on the hairs that does not interfere with or substantially alter playing of a musical instrument, the method comprising dying, screening, printing, coloring, or drawing the at least one mark on a plurality of hairs to identify the different playing sections and binding the hairs before or after applying the at least one mark so that the individual hairs cannot move relative to one another with a binder that is constructed and arranged to mount to a frog or a tip of a bowstick.

* * * * *